United States Patent [19]

Ecton

[11] 3,973,337

[45] Aug. 10, 1976

[54] SHOE AND METHOD OF MAKING

[75] Inventor: W. Robert Ecton, Towson, Md.

[73] Assignee: Dixon-Bartlett-Lambrecht, Inc., Baltimore, Md.

[22] Filed: Apr. 25, 1975

[21] Appl. No.: 571,564

[52] U.S. Cl. ..... 36/51; 12/146 C

[51] Int. Cl.[2] ..... A43B 23/00

[58] Field of Search ..... 36/45, 51; 12/146 C, 12/146 CK

[56] References Cited

UNITED STATES PATENTS

| | | | |
|---|---|---|---|
| 2,185,362 | 1/1940 | Troy | 36/45 |
| 2,223,339 | 12/1940 | DeLiso | 36/45 |
| 2,274,085 | 2/1942 | Mitulski | 36/45 |
| 2,958,966 | 11/1960 | Huberman | 36/51 |
| 3,007,262 | 11/1961 | Richards | 36/51 |
| 3,084,460 | 4/1963 | Huberman | 36/51 |
| 3,162,962 | 12/1964 | Simons et al. | 36/51 |

OTHER PUBLICATIONS

Das ABC der Schuh-Fabrikation, 3/9/1934, Seite 426.

*Primary Examiner*—Alfred R. Guest
*Attorney, Agent, or Firm*—Wilmer Mechlin

[57] ABSTRACT

A shoe having a stretchable foot opening bounded by a normally gathered binding having a tunnel extending longitudinally therethrough and attached below the tunnel to and extending substantially around an upper edge of a shoe upper, and a stretched elastic tape free floating in and extending through the tunnel, the tape being stretched and the binding gathered by pulling on ends of the tape to pull out end portions of predetermined lengths after the binding is attached to the upper and the stretch being held by securing the end portions together.

9 Claims, 8 Drawing Figures

SHOE AND METHOD OF MAKING

BACKGROUND OF THE INVENTION

As disclosed in the patents U.S. Pat. No. to Troy 2,185,362, U.S. Pat. No. to Rape 2,210,841, U.S. Pat. No. to De Liso 2,223,339 and U.S. Pat. No. to Mitulski 2,274,085, shoes, such as women's pumps, have heretofore been made with stretchable foot openings by securing an elastic tape throughout its length to the inside of a shoe upper below the opening, with the tape extending either partly or substantially entirely around the opening. It is to be an improved shoe having a stretchable foot opening and a method of making it that the present invention is particularly directed.

SUMMARY OF THE INVENTION

The primary object of the present invention is to provide an improved shoe and method of making the same, whereby a wearer's foot is yieldably gripped around the shoe's foot opening by the force of a stretched elastic tape free floating in and substantially coterminous longitudinally with a binding bounding the opening and secured below the tape to the shoe upper, the tape being stretched and having its end portions secured together after the binding is secured to the upper.

Another object of the invention is to provide an improved method of making a shoe having a stretchable foot opening for yieldably gripping a wearer's foot, wherein a binding of a length to bound the opening and having a tunnel extending longitudinally therethrough and unstretched elastic tape of substantially the same length free floating in the tunnel, is secured below the tunnel to the shoe upper, the tape is stretched and the binding gathered by pulling in opposite directions on ends of the tape to expose end portions of predetermined length, and the exposed end portions of the stretched tape are then secured together adjacent ends of the binding to hold the stretch.

An additional object of the invention is to provide an improved shoe having a stretchable foot opening, wherein the opening is bounded by a binding extending end-to-end from the back of the shoe around the opening, the binding having a tunnel extending longitudinally therethrough, a stretched elastic tape free floating in and extending through the tunnel enables the normally gathered binding to yieldably grip a wearer's foot substantially uniformly around the opening, and the binding also is elastic for increased user comfort and ease particularly in putting on and taking off a shoe.

A further object of the invention is to provide an improved shoe having a stretchable foot opening, whereby a wearer's foot is enabled to be yieldably gripped substantially uniformly about the opening without distorting the shape of the shoe upper, by bounding the opening by a binding edge-overlapping and secured to the inside of the upper marginal edge portion of the upper and having free floating therein a stretched elastic tape.

Other objects and advantages of the invention will appear hereafter in the detailed description, be particularly pointed out in the appended claims, and be illustrated in the accompanying drawings, in which:

FIGURE DESCRIPTION

DETAILED DESCRIPTION

Figure 1:
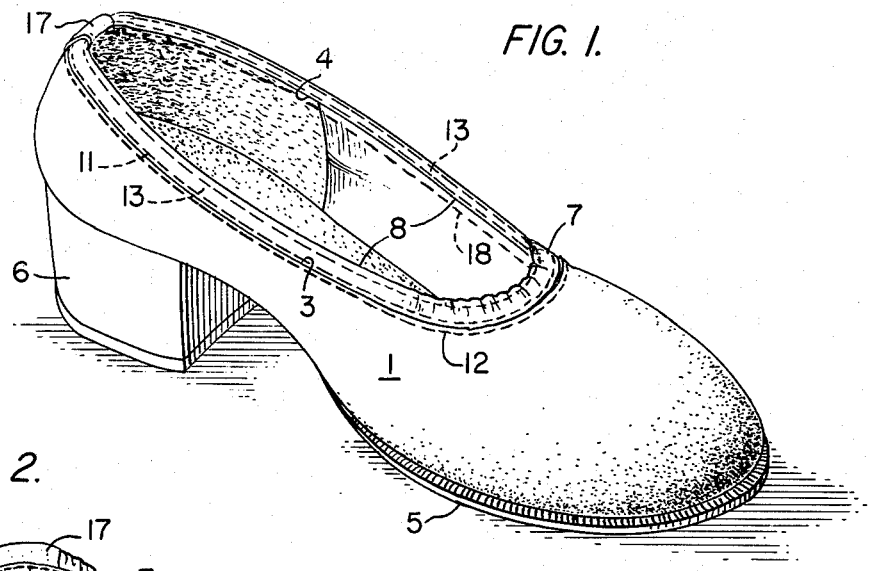
FIG. 1 is a perspective view of a finished shoe embodying the present invention.
Figure 2:
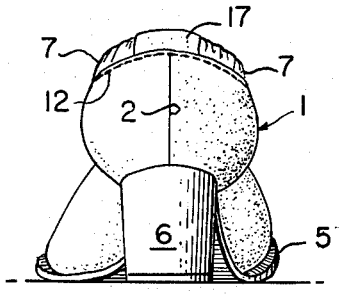
FIG. 2 is a rear elevational view of the shoe of FIG. 1.
Figure 3:
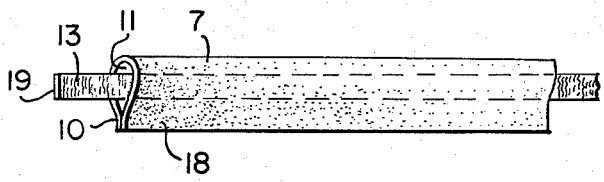
FIG. 3 is a fragmentary perspective view of binding material folded longitudinally to form a tunnelled binding with an unstretched elastic tape in the tunnel.
Figure 4:
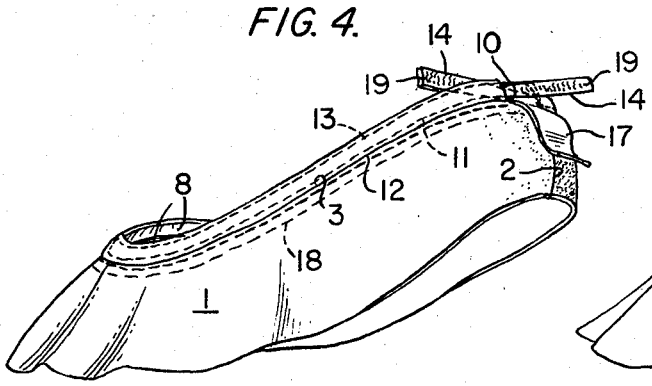
FIG. 4 is a perspective rear quarter view of an unmolded upper with the binding of FIG. 3 stitched thereto and the tape stretched.
Figure 5:
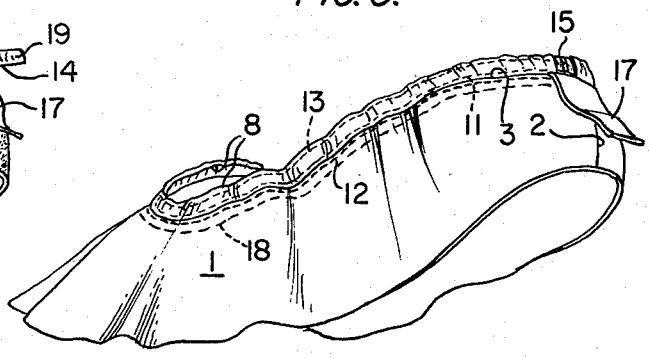
FIG. 5 is a view similar to FIG. 4, but with the end portions of the stretched tape clipped together.
Figure 6:
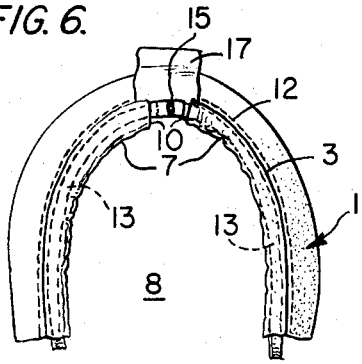
FIG. 6 is a fragmentary plan view of the rear part of the structure of FIG. 5, also with the excess tape removed.
Figure 7:
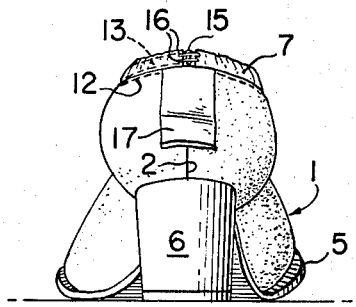
FIG. 7 is a rear elevational view of the structure of FIG. 5 after clipping of the binding ends to each other and the tape.
Figure 8:
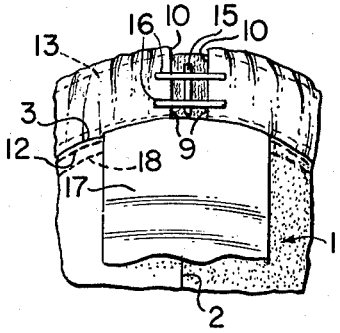
FIG. 8 is a fragmentary rear elevational view on an enlarged scale of the upper portion of the structure of FIG. 7.

Referring now in detail to the drawings in which like reference characters designate like parts, the improved shoe and method of the present invention, while not limited to particular types of shoes, are particularly designed as and for making women's pumps, such as illustrated in FIG. 1, and will be so described as exemplary of the invention.

The improved shoe is comprised of an upper 1 of leather or other suitable material, which, depending on the design, may be of one or plural-piece construction and, as illustrated, usually will have opposite sides stitched or otherwise joined at the back along a back seam 2. The upper 1 bounds by its upper marginal edge or extremity 3, a throat or upper opening 4, which, after the then usually lined upper has been molded into shape and the sole 5 and heel 6, if any, have been applied, will be of a size and shape substantially to fit the corresponding part of the foot (not shown) of a prospective wearer. Projecting above and extending substantially entirely or fully around the throat 4 of the upper 1, is a binding, edging or collar 7 stitched or otherwise attached or secured in edge-overlapping relation to and usually inside the upper.

Terminating at ends at the back of the shoe and continuous therebetween, the preferred binding 7 itself bounds or extends around or surrounds the shoe's foot opening 8, except for a suitably narrow gap 9 at the back between the binding's ends 10. Made of suitable material, usually leather, and either inelastic or to a desired degree elastic, the binding 7 has a tunnel 11 extending longitudinally therethrough above the upper's upper edge 3 or, more precisely, the stitch or other line or band 12 along which the binding is attached to the upper. Also above the upper edge 3 or attachment line 12, the binding 7, in foot-off or normal condition, is gathered, puckered or contracted by a stretched or elongated elastic tape or net 13 free floating, unsecured or loose in and extending through the tunnel 11. Responsible for both gathering the binding 7 in foot-off condition and, through the binding, yieldably gripping a wearer's foot about or around the foot opening 8, the stretching or tensioning of the elastic tape 13 is held, set or fixed within a predetermined range or between predetermined limits, by connecting, joining or securing together overlapping end portions 14 of the tape exposed between and projecting beyond the binding ends 10, as by clipping or stapling by a tape clip or staple 15. Longitudinal shifting of the otherwise free floating stretched tape 13 relative to the gatherable binding 7, to the detriment of the tape's gripping action, preferably is prevented and the binding at the same time strengthened at the back, by joining, connecting or securing the binding ends 10 to each other and the tape, as by one or more binding clips or staples 16. A back tab 17, overlapping and stitched or otherwise secured to the outside and inside of the binding 7, covers the otherwise exposed binding and tape joints and connecting clips in the finished shoe.

In making the improved shoe by the improved method of this invention, the upper 1 and binding 7 are made separately, the upper, if, as illustrated, of one piece, being cut or punched of a size and shape for the intended shoe from a skin or sheet of leather or other suitable material and then having its free ends stitched or otherwise connected together along the back seam 2. The binding 7 is made from an elongated, preferably generally oblong or rectangular piece of suitable material, usually leather, folded longitudinally or along its longitudinal center line to form the tunnel 11. The elastic tape 13, in unstretched or free condition, conveniently is inserted in the tunnel 11 either as or after the binding material is folded. After the tape is inserted through the then open side of the tunnel, that side opening preferably is closed by securing together by a suitable adhesive the free or lower edge portions 18 of the binding. Ordinarily, the binding 7 and contained unstretched tape 13, rather than being made up individually for each shoe, will be formed as a strip of an extended length sufficient to supply the needs or requirements of a number of shoes. Suitably cut to length from the long supply strip, the binding 7 and unstretched tape 13 for an individual shoe will be substantially the same length or coterminous and of a length to fit or extend substantially around the throat 4 or upper marginal edge 3 of the upper. To facilitate subsequent stretching, the tape, when inserted, preferably is narrower than the tunnel 11 so as to float freely therein in both unstretched and stretched conditions.

To function as intended, the binding 7 is made of relatively soft, flexible or yieldable material so that it can be gathered or contracted when the tape 13 is stretched or tensioned and be substantially ungathered, smooth or extended when on a wearer's foot. Additionally, the binding itself preferably is somewhat elastic for providing increased stretch or elongation as necessary to accommodate a particular foot.

In the next step, the binding 7, with the then unstretched tape in and its ends 19 at or accessible through the ends of the tunnel 11, is stitched or otherwise attached below the tunnel or tape, in edge-overlapping relation, preferably to the inside of the upper 1 below and substantially fully or entirely around or about the upper's upper edge 3. The binding 7 suitably is attached to the upper with its ends 10 adjacent and on opposite sides of the back center seam 2 and therebetween the narrow gap 9 to which the tape ends 19 are exposed or presented. Drawn from the binding ends 10, as by surgical tweezers, preferably with one inside and the other outside the binding for a smooth overlap or crossing, the tape ends 19 are then grasped and pulled in opposite directions to pull out or expose end portions 14 of predetermined length from and between or beyond the binding ends 10 and, by the resultant stretch or elongation, place the stretched tape under a predetermined tension and gather or contract the binding.

To hold or fix the tension of the stretched tape 13, its overlapping or crossed end portions 14 are secured, joined or connected together, preferably by clipping or stapling within the gap 9 and adjacent the binding ends 10. Thereafter, the excess tape beyond the connection is cut off or removed. After evening out the gathering of the binding and narrowing the gap 9, as desired, the ends 10 of the binding are secured to each other and the tape 13, again preferably by clipping or stapling. In clipping first the tape and then the binding ends, it is convenient that the clip 15 for the tape be vertical and that the one or more clips 16 for the binding ends be horizontal and overlap, straddle or cross the tape clip.

To cover the gap 9 and clips 15 and 16 in the finished shoe and thus protect a wearer's heel, the outer end portion of the back tab 17 is inserted between the upper 1 and the binding 7 and secured in place incident to their attachment. Then reduced to a loose flap secured only at the outside of the binding 7, the tab 17 remains in that condition until the tape end portions and binding ends have been joined, when it is folded or pulled over the joint and has its inner end secured to the inside of the binding. From this step, the shoe is finished in the usual manner by molding the upper on a suitable molding machine and attaching thereto the sole 5, heel 6 and an inner sole or sock liner.

With the yieldable gripping of a wearer's foot confined to the contractable binding 7 and produced by the stretched elastic tape 13 free floating in the binding and therewith substantially surrounding or encircling the foot opening 8, the tape is not restrained or inhibited in its gripping action by the upper 1 and can apply its force substantially uniformly around the opening, while the upper is available without substantial distortion for maintaining its molded shape, including that of its throat 4. Also, while gathered in normal or foot-off condition, the binding 7, when gripping a foot, is not appreciably gathered and conceals both the tape 13 and its action from an observer.

It should be understood that the described and disclosed embodiments of the improved shoe and method are merely exemplary of the invention and that all modifications are intended to be included that do not depart from the spirit of the invention and the scope of the appended claims.

Having now described my invention, I claim:

1. A shoe having a stretchable foot opening, comprising a laterally uninterrupted elastic binding bounding said opening and having a tunnel extending longitudinally therethrough, said binding in substantially ungathered and unstretched condition being attached adjacent a bottom of said tunnel in edge-overlapping relation to and projecting above an upper edge portion of an upper of the shoe, and a stretched elastic tape free floating in and extending through said tunnel and having ends secured together above said upper for gathering said binding and therethrough yieldably gripping a foot of the wearer.

2. A shoe according to claim 1, wherein the binding is attached below the tunnel to the inside of the upper.

3. A shoe according to claim 1, wherein the binding is attached below the tunnel to the upper, and the binding and tape extend substantially entirely around the opening and are secured at ends at a back of the shoe.

4. A shoe according to claim 3, including tab means covering the secured ends of the binding and tape, and said tab means has opposite end portions secured to opposite sides of the binding below the tunnel.

5. A shoe according to claim 4, wherein the ends of the binding are secured to each other and the tape.

6. A method of making a shoe, comprising forming a laterally uninterrupted elastic binding of a length to bound and extend substantially around a foot opening of a shoe and having a tunnel extending longitudinally therethrough, containing in said tunnel in free floating relation and unstretched condition a substantially coterminous elastic tape, with said binding substantially ungathered and said binding and tape unstretched attaching said binding below said tunnel and in edgeoverlapping relation to an upper edge portion of a shoe upper, stretching said tape and gathering said binding by pulling on ends of said tape to expose end portions of predetermined length beyond ends of said binding, and holding said tape in stretched condition by securing said exposed end portions thereof together adjacent said binding ends and above said upper.

7. A method according to claim 6, wherein the binding is attached to an inside of the upper with the ends thereof and of the tape at a back of the shoe, and including securing the ends of the binding to each other and the tape with the tape held in stretched condition, attaching an outer end portion of a tab between the binding and the upper at the back of the shoe when the binding is attached to the upper, and covering the secured end portions of the stretched tape and ends of the binding by attaching an inner end portion of said tab to the inside of the binding.

8. A method according to claim 6, wherein the binding with the tunnel is formed by longitudinally folding an elongated piece of elastic binding material and securing together lower edge portions of said folded piece, and the unstretched tape is placed in the binding during forming thereof;

9. A method according to claim 6, wherein the binding and unstretched tape are made up as a supply strip from which requirements for individual shoes are cut to length.

* * * * *